US010647466B2

(12) United States Patent
Zwaga et al.

(10) Patent No.: US 10,647,466 B2
(45) Date of Patent: May 12, 2020

(54) PACKAGING FOR MODIFIED ATMOSPHERE PACKAGING

(75) Inventors: Ronald Zwaga, Alemlo (NL); Remi De Olde, Almelo (NL); Alain Wietse Bastiaan Tasma, Almelo (NL); Gerard Buis, Enter (NL)

(73) Assignee: PACKABLE B.V., Almelo (NL)

( * ) Notice: Subject to any disclaimer, the term of this patent is extended or adjusted under 35 U.S.C. 154(b) by 371 days.

(21) Appl. No.: 13/824,834

(22) PCT Filed: Sep. 26, 2011

(86) PCT No.: PCT/EP2011/066637
§ 371 (c)(1),
(2), (4) Date: Jun. 6, 2013

(87) PCT Pub. No.: WO2012/049005
PCT Pub. Date: Apr. 19, 2012

(65) Prior Publication Data

US 2013/0327821 A1 Dec. 12, 2013

(30) Foreign Application Priority Data

Oct. 14, 2010 (EP) ..... 10187566
May 13, 2011 (EP) ..... 11166049

(51) Int. Cl.
*B65D 5/56* (2006.01)
*B65D 1/22* (2006.01)
(Continued)

(52) U.S. Cl.
CPC ..... *B65D 1/22* (2013.01); *B65D 5/563* (2013.01); *B31B 2105/00* (2017.08);
(Continued)

(58) Field of Classification Search
CPC ..... B31B 7/00; B31B 2217/0053; B31B 2217/084; B31B 2217/068; B65D 1/22; B65D 5/563
See application file for complete search history.

(56) References Cited

U.S. PATENT DOCUMENTS 3,195,425 A * 7/1965 Taggart ..... B29C 51/165 229/5.85
3,390,618 A * 7/1968 McArdle ..... B29C 51/162 493/95
(Continued)

FOREIGN PATENT DOCUMENTS

DE 19654230 A1 * 7/1998
DE 20306120 U1 8/2003
(Continued)

*Primary Examiner* — Andrew M Tecco
(74) *Attorney, Agent, or Firm* — The Webb Law Firm

(57) ABSTRACT

The invention relates to a method for providing a packaging for modified atmosphere packaging, which method comprises the steps of: providing an unfolded sheet for folding a box; folding the unfolded sheet to a box having at least an access opening and flange parts bordering the access opening, which flange parts compose an endless circumferential flange; providing a plastic foil; heating the plastic foil; pressing the heated plastic foil against the inner wall of the box and covering the circumferential flange, such that the plastic foil is laminated to box. The invention further relates to a packaging.

4 Claims, 5 Drawing Sheets

(51) Int. Cl.
*B31B 120/40* (2017.01)
*B31B 105/00* (2017.01)
*B31B 110/30* (2017.01)

(52) U.S. Cl.
CPC ... *B31B 2105/0024* (2017.08); *B31B 2110/30* (2017.08); *B31B 2120/404* (2017.08); *B31B 2120/406* (2017.08)

(56) References Cited

U.S. PATENT DOCUMENTS 3,779,447 A 12/1973 Bemiss
3,932,105 A 1/1976 Knoell
4,056,221 A * 11/1977 Piltz ..... B31B 7/00 229/164.1
4,200,481 A * 4/1980 Faller ..... B29C 51/165 156/285
4,257,530 A * 3/1981 Faller ..... B29C 51/165 206/484
4,337,116 A * 6/1982 Foster ..... B29C 51/162 156/212
5,253,801 A * 10/1993 Bernstein ..... B65D 5/20 229/110
5,323,956 A 6/1994 Marcontell
5,356,070 A * 10/1994 Rigby ..... 229/120.17
6,145,281 A 11/2000 Hansen et al.
8,011,568 B2 * 9/2011 Maeaettae ..... B29C 43/203 229/125.35
2005/0115975 A1 6/2005 Smith et al.
2009/0152333 A1 * 6/2009 Maeaettae ..... B29C 43/203 229/104
2010/0193578 A1 8/2010 Sanders
2010/0316855 A1 12/2010 Bethune

FOREIGN PATENT DOCUMENTS

EP 0268427 A2 5/1988
EP 0283145 A2 9/1988
EP 0608599 A2 8/1994
EP 0608971 A2 8/1994
FR 2406522 5/1979
FR 2406522 A * 6/1979
FR 2487297 1/1982
FR 2487297 A * 1/1982
FR 2826938 A1 1/2003
FR 2925390 A1 6/2009
GB 1211470 11/1970
GB 1376502 12/1974
WO 8604880 A1 8/1986
WO 9967143 A2 12/1999

* cited by examiner

PACKAGING FOR MODIFIED ATMOSPHERE PACKAGING

BACKGROUND OF THE INVENTION

Field of the Invention

The invention relates to a method for providing a packaging for modified atmosphere packaging.

Description of Related Art

In order to prolong the expiration date of packaged foodstuff, it is known to arrange the foodstuff in an airtight packaging. Without an airtight packaging continued access of air to the foodstuff is possible, which fuels the putrefication process. If the amount of air is limited by the airtight packaging, the putrefication process will be stopped after a short time.

It is further known to replace the air in the packaging with another gas, like for example nitrogen. As the air is replaced by an inert gas, the putrefication process will be stopped as soon as the foodstuff is packaged.

Generally a plastic box with a circumferential flange is provided in which the foodstuff is placed. An inert gas, like nitrogen is fed into the packaging, after which the box is closed by a sealing foil. The sealing foil is attached to the circumferential flange. To ensure a reliable sealing, it is necessary to have a flat flange, without any steps, such that the sealing foil can be pressed along the full length of the circumferential flange.

The boxes used for modified atmosphere packaging are typically made by thermoforming of a sheet of plastic. In this method a sheet of plastic is heated and pushed in a mould. Then the sheet of plastic is cooled such that the plastic sheet maintains the box shape. These plastic boxes are then stacked and transferred to a filling line, where the boxes are filled with foodstuff and the boxes are airtight sealed with a sealing foil.

The use of plastic is not environmental friendly. Accordingly, there is a trend to reduce the amount of plastic in packaging by using other materials, like cardboard. Boxes can be made from a cardboard sheet, which is folded to a box. Walls of the box have overlapping parts, which are glued together to keep the folded sheet in the box shape. These overlapping parts provide steps in the surface of the box, which cannot guarantee airtightness.

In order to be able to seal a foil to the cardboard box, the cardboard has to be provided with a suitable layer. This layer is typically laminated to the cardboard. This limits the flexibility, because it is difficult to quickly change the layer laminated to the cardboard. This would require to keep a number of different types of laminated cardboard in stock to be able to quickly respond to changing demands.

WO 9967143 discloses a method for providing a packaging for modified atmosphere packaging. From a sheet of cardboard two pieces are cut. The first piece is folded to a box with a bottom and upright walls. The second piece is shaped as a circumferential flange with attachment parts. The flange is attached to the first piece to form a cardboard box and to keep the first piece in the box shape.

When the box is made from the two pieces, the box is transported to a filling line. At the filling line a sheet of plastic pulled over the box and the sheet is heated. Then air is sucked from the space between the box and the heated sheet, such that the sheet is pulled into the box and laminated to the inner wall of the box. The sheet is also laminated to the flat circumferential flange.

Then the box, provided with the laminated sheet, is filled with foodstuff and the box is sealed by a sealing foil. As the circumferential flange is cut as a whole from the sheet, the flange is fully flat, such that a sealing foil can be reliable and airtight arranged to the flange.

This method of providing a packaging consumes a lot of cardboard. Especially, cutting out the flange part as a whole from a sheet results in a lot of waste material. Furthermore, the two pieces have to be joined first, before the plastic sheet can be laminated in the box.

FR 2487297 discloses a method for folding a box from an unfolded sheet and then arranging a heated sheet of plastic to the inner walls of the box. The sheet of plastic stops in this embodiment just beneath the top edge of the box. This publication further discloses to wrap the sheet of plastic around the top of the walls against the outer surface of the walls. This has the advantage of a stronger box, especially at the corners of the box.

It is an object of the invention to reduce or even remove the above mentioned disadvantages of the prior art.

SUMMARY OF THE INVENTION

This object is achieved with a method according to the invention, which method comprises the steps of:

- providing an unfolded sheet for folding a box;
- folding the unfolded sheet to a box having at least an access opening and horizontal flange parts bordering the access opening, which flange parts compose an endless circumferential flange;
- providing a plastic foil;
- heating the plastic foil;
- pressing the heated plastic foil against the inner wall of the box and covering the circumferential flange, such that the plastic foil is laminated to box.

The circumferential flange is composed out of a number of flange parts. These flange parts are kept together and the folded sheet is kept in the box shape by laminating the plastic foil to the inner wall of the box and the flange parts. So, with the method according to the invention, the box is composed out of a single sheet and kept in shape by laminating the plastic foil to the sheet. Overlapping parts, which are glued together, are not necessary to construct the box of the invention. Thus, the plastic foil provides the connection to keep the several parts in position.

Because the plastic foil extends over the horizontal flange parts and does not stop just beneath the top of the access opening, additional strength is provided to the box and the horizontal flange. When the box is subjected to forces urging the walls outward, the plastic foil at the horizontal flanges is subjected to a stretch force, whereas with a box according to for example FR 2487297 the plastic foil would be subjected to a tear force.

As the plastic foil is far more resistant to stretch forces than to tear forces, a stronger box is provided with the invention.

Another aspect of the invention is that the plastic foil is only arranged on the upper side of the horizontal flange, which facilitates sealing of the box with a sealing foil on a suitable sealing mould, which is pressed against the bottom side of the horizontal flange. As the bottom side of the flange is a cardboard surface, the sealing mould will not stick to flange, which would be the case if the plastic foil would also be arranged to the bottom side of the horizontal flange.

Another advantage of the invention is that the unfolded sheets can be printed on both sides, such that a printed side will form the inner wall of the box. As the inner wall is laminated with the plastic foil, the printing will have no adverse effect on the content of the packaging.

The unfolded sheets are typically stacked, before fed to a machine for producing the boxes according to the invention. When the sheets are printed, the printed outside would be in contact with the inside surface of the next unfolded sheet. As a result of this contact, the ink arranged on the outside could migrate to the inside of a next sheet. Because the box according to the invention is laminated on the inside with a plastic foil, this migrated ink cannot get into contact with the foodstuff to be packaged in the box.

Preferably adjacent edges of flange parts abut, and the flange parts abut only at their edges such that the flange parts are all arranged in a single plane. This results in a flat circumferential flange without any steps. With such a flat flange a reliable sealing of a closing foil to the box can be guaranteed.

In an embodiment of the invention adjacent wall parts of the box abut. These abutting wall parts are fixated relative to each other by the plastic foil laminated to the inside of the box. As the wall parts abut and the plastic foil fixates the wall parts, the wall parts contribute to the rigidity of the box. If the wall parts would overlap or a space would be present between the wall parts, the wall parts could shift relative to each other and result in a weak box. It could also result in steps in the circumferential flange, which prevents airtight sealing of a foil to the flange. These disadvantages are prevented in this embodiment in which the wall parts abut.

In another embodiment of the method according to the invention low pressure is generated between the inner wall of the box and the heated plastic foil for pressing of the foil against the inner wall of the box. By creating low pressure between the heated plastic foil and the inner wall of the wall, the ambient pressure will press the foil into the box and against the inner wall. This pressure also provides the necessary force for laminating the foil to the walls.

The walls of the box could be provided with suction openings for creating low pressure between the inner wall of the box and the heated plastic foil. The suction openings make it easier to control the laminating of the foil to the inner wall.

These suction openings could be as large to provide a window for displaying the content of the box. The plastic foil is generally translucent or even transparent, such that the opening is sealed and could function as display window.

Still another embodiment of the method according to the invention further comprises the step of providing a pressing force for pressing the heated plastic foil into the box and against the inner wall. This pressing force can for example be generated by a mould, which is pressed into the box. With such a pressing mould, it is for example also possible to trim the heated plastic foil along the edge of the circumferential flange.

In a preferred embodiment, suction openings are provided at the corners of the box. These suction openings at the corners of the box ensure that the heated plastic foil will be pulled in a controlled way into the corners of the box.

In yet another embodiment of the method according to the invention the unfolded sheet is folded to a box, by pressing the unfolded sheet in the mould. The mould provides the desired shape and ensures that the unfolded sheet is folded correctly, which is especially of importance to have the wall parts and flange parts to abut.

It is also possible in an embodiment of the method according to the invention to arrange the unfolded sheet in a lower mould such that a box is folded from the sheet, to arrange the plastic foil over the folded box and to press a substantially flat upper mould on top of the lower mould.

The upper mould is heated and will heat the plastic foil. Possibly, the inner surface of the upper mould is provided with a plurality of suction openings for sucking the plastic foil against the substantially flat upper mould.

As soon as the plastic foil is weak due to the heat, a low pressure is created in the folded box and possibly a high pressure is created above the heated foil, by blowing air through the suction openings. As a result the heated and weakened foil is pressed against the inside of the folded box by the generated pressure difference, such that the foil is laminated to the box. As the box is not heated, the foil will quickly cool down, after which the moulds can be opened, the laminated box can be removed and the method can be repeated for a new box.

In still another embodiment the method according to the invention further comprises the steps:

filling the box with foodstuff;

providing a sealing foil; and sealing the sealing foil on the circumferential flange, such that the foodstuff is airtight sealed.

Because the box according to the invention is filled with foodstuff and sealed inline, the chance on migration of ink is prevented. When printed boxes would be stacked, as known in the prior art, the inside of a box would get into contact with the outside of the adjacent nested box. Due to this contact ink from the outside of a box can get into contact with the inside of a box and thus get into contact with the foodstuff.

It could be preferred to laminate a number of boxes at the same time with a single plastic foil and to keep the boxes connect by the plastic foil like a chain. After filling the chain of boxes with for example foodstuff, a sealing foil can be sealed on to the boxes, after which the edges of the boxes, including the sealing foil are trimmed separating the boxes from each other.

When trimming the edges of the boxes, including a sealing foil, it is possible to provide an easy peel part. For example a cutout can be provided in the horizontal flange of the box, while the sealing foil extends over this cutout portion.

The invention further relates to a packaging for modified atmosphere packaging comprising:

a box folded from a sheet having an access opening and flange parts bordering the access opening, wherein adjacent flange parts abut to compose an endless circumferential flange; and a plastic foil laminated to the inner wall of the box, wherein the plastic foil extends over the circumferential flange. The plastic foil is laminated to the sheet folded to a box having a circumferential flange and ensures that the box keeps its shape. As the flange parts abut, a flat circumferential flange is provided to which a closing foil can be reliably and airtight attached.

In a preferred embodiment of the packaging according to the invention adjacent wall parts of the box abut and are fixated in position only by the laminated plastic foil. By having the wall parts abut, no overlapping wall parts are present, nor is a space present between adjacent wall parts, resulting in a firm box.

In another preferred embodiment of the packaging according to the invention openings are provided in the corners of the box. The openings in the corners assist in laminating the plastic foil correctly, but also make it possible to provide a beveled corner, such that the plastic foil does not need to be stretched to its limits.

Preferably the plastic foil comprises polylactic acid (PLA). PLA is a biodegradable plastic, which provides in combination with for example cardboard for the unfolded sheet, a fully biodegradable packaging. For another purpose, polyethylene terephthalate (PET) can be used. With such a laminate, the packaging of the invention can be used in an oven.

Also a multilayer plastic foil can be used, in which one of the layers is an Ethylene Vinyl Alcohol (EVOH) layer. With this multilayer plastic foil arranged in the box, an airtight barrier is created by the EVOH layer between the content of the box and the atmosphere.

Yet another advantage of the packaging according to the invention is that the cardboard box lined with the plastic foil is very environmental friendly. The plastic foil can have such a small thickness, that the cardboard box lined with the plastic foil is considered a monomaterial and may be discarded as regular cardboard.

On the other hand a relatively thick plastic foil can be arranged in the box, such that on disposal, the plastic foil can be removed from the box. The box and the plastic foil can then be discarded separately.

BRIEF DESCRIPTION OF THE DRAWINGS

These and other features of the invention will be elucidated in conjunction with the accompanying drawings.

DETAILED DESCRIPTION OF THE INVENTION

Figure 1A:
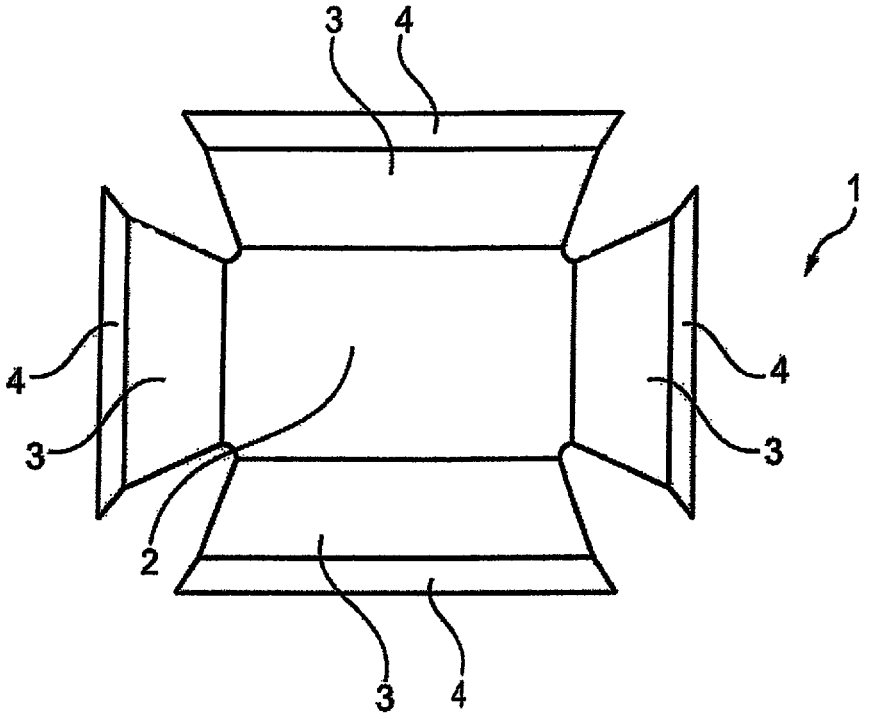
FIGS. 1A-1D shows schematically the steps of an embodiment of the method according to the invention.

FIG. 1A shows a cut unfolded sheet 1 for a packaging according to the invention. This cut unfolded sheet 1 has a bottom 2, wall parts 3 and flange parts 4.

Figure 1B:
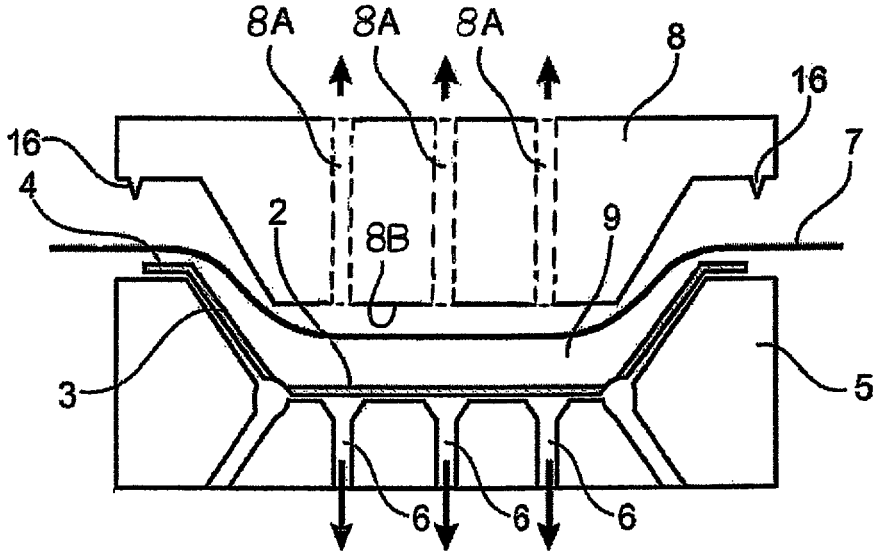

This cut and unfolded sheet 1 is moved over a mould 5 (see FIG. 1B) and pulled in the mould 5 by sucking the air through the primary suction opening 6. By pulling the unfolded sheet 1 into the mould, the sheet 1 is folded into the desired box shape.

As soon as the sheet 1 is formed in the mould 5, a plastic foil 7 is transferred over the opening 9 in the box 1. The plastic foil 7 is heated by a heated counter mould 8, also referred to as the upper mould, such that the plastic foil 7 can easily be deformed.

Figure 1C:
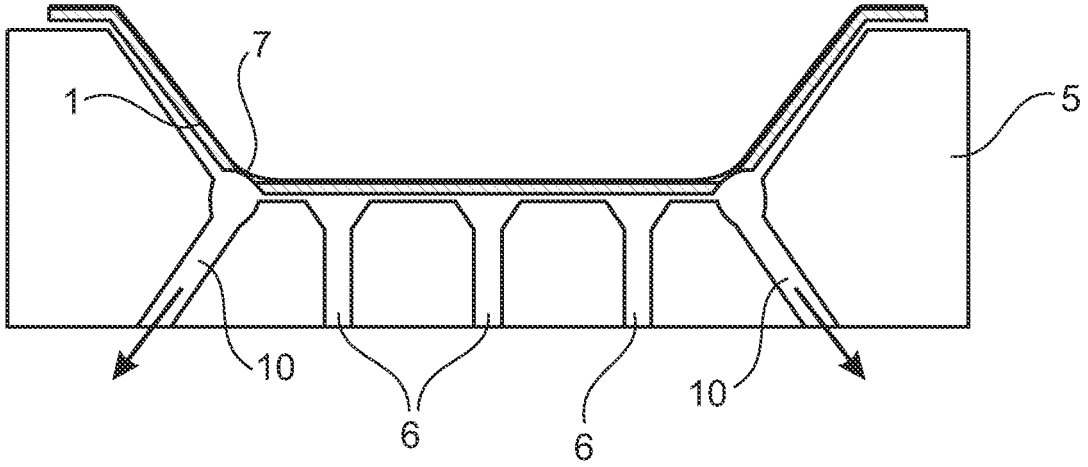
Figure 1D:
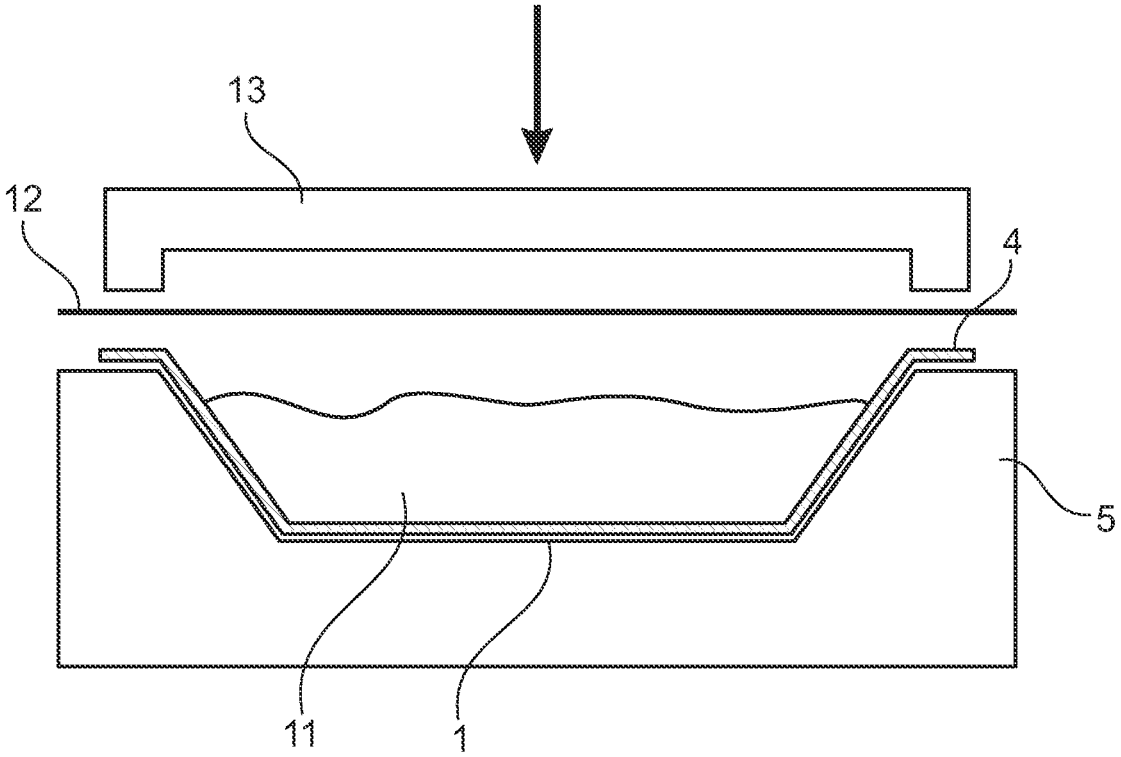

When the plastic foil 7 is sufficiently heated by the counter mould 8, air is sucked through openings at the corner of the box 1 by the secondary suction openings 10 (see FIG. 1C). As a result low pressure is created in the space between the box 1 and the plastic foil 7. Due to this low pressure the plastic foil 7 is pressed against the bottom 2, wall parts 3 and flange parts 4. Simultaneously, the counter mould 8 is pressed into the mould 5, which provides additional pressure for simultaneously pressing the plastic foil 7 against the bottom 2, the wall parts 3 and the flange parts 4.

The heated counter mould 8 is provided with a trimming knife 16 for trimming the plastic foil 7 along the edge of the circumferential flange 4.

The combination of box 1 and laminated plastic foil 7 is then filled with foodstuff 11 and covered by a sealing foil 12. This sealing foil 12 is sealed to the circumferential flange 4 by a sealing tool 13. Before sealing the foil 7 to the flange 4 a gas, for example nitrogen, can be blown between the foodstuff 11 and the sealing foil 12, such that air is replaced by the gas.

Figure 2:
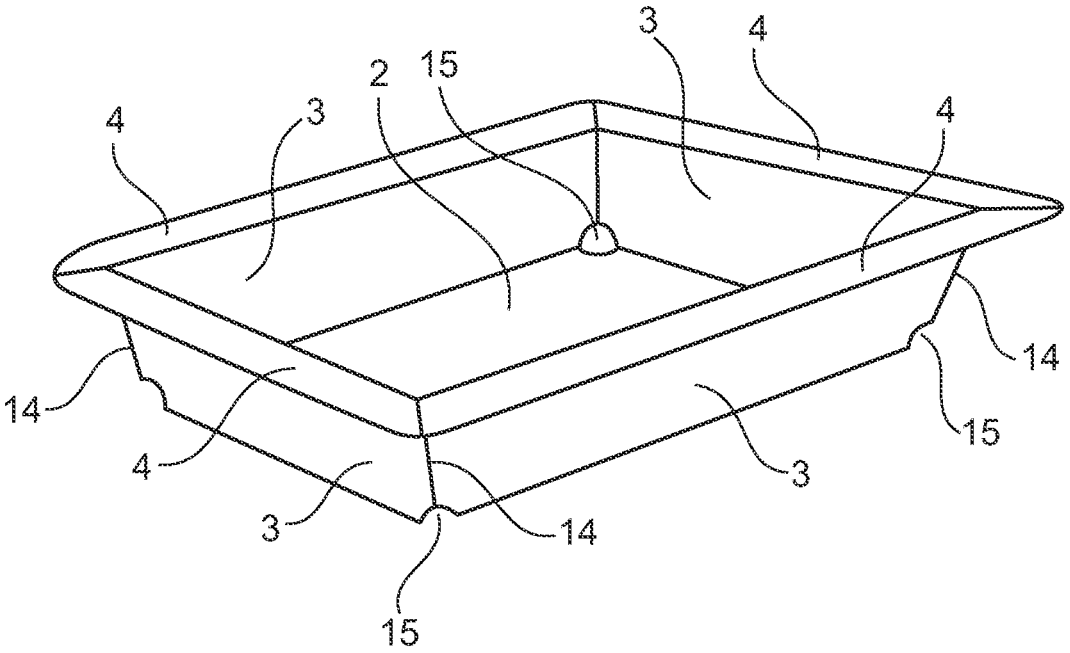
FIG. 2 shows in perspective view a first embodiment of a packaging according to the invention.

FIG. 2 shows an embodiment of a packaging according to the invention. This packaging has a bottom 2, wall parts 3 and flange parts 4. The wall parts 3 abut at the edges 14. Box suction openings 15 are arranged at the intersection of the edges 14 with the bottom 2.

Figure 3:
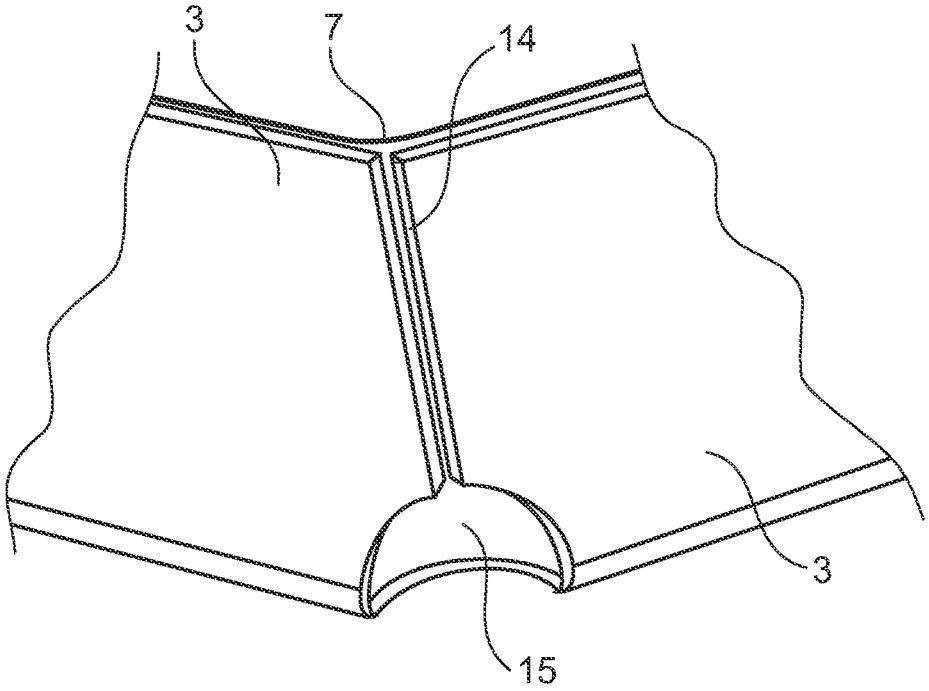
FIG. 3 shows a detail of the embodiment according to FIG. 2.

As shown in more detail in FIG. 3, the wall parts 3 are kept abutting by the plastic foil 7, which is laminated to the inner wall of the wall parts 3. Because the wall parts 3 abut and do not overlap, these wall parts cannot shift over each other, providing rigidity to the box 1.

Figure 4:
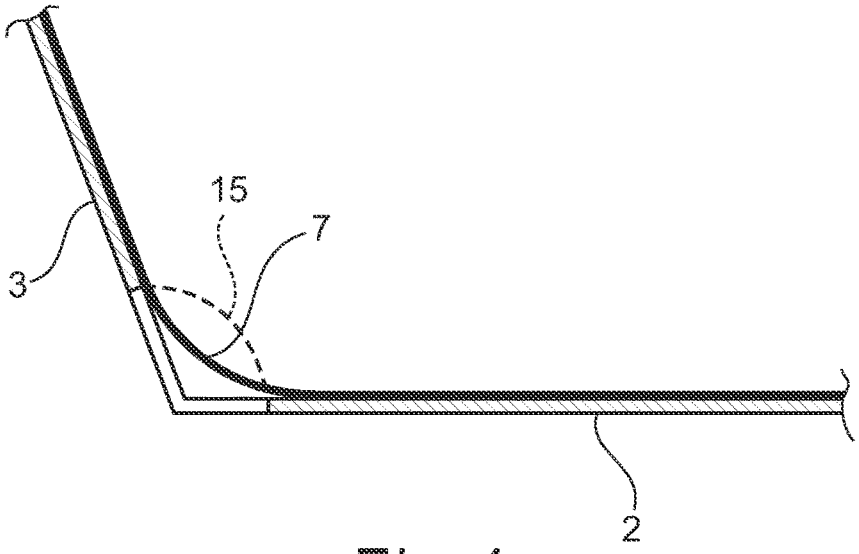
FIG. 4 shows a cross sectional view of the embodiment of FIG. 2.

FIG. 4 shows a cross sectional view of the detail of FIG. 3. It is clear that the plastic foil 7 is not pulled completely in the corner 15, but has an acceptable radius limiting the local strain in the plastic foil 7. The curvature of the plastic foil 7 at the corner 15 can be assisted by a suitable mould 5.

Figure 5:
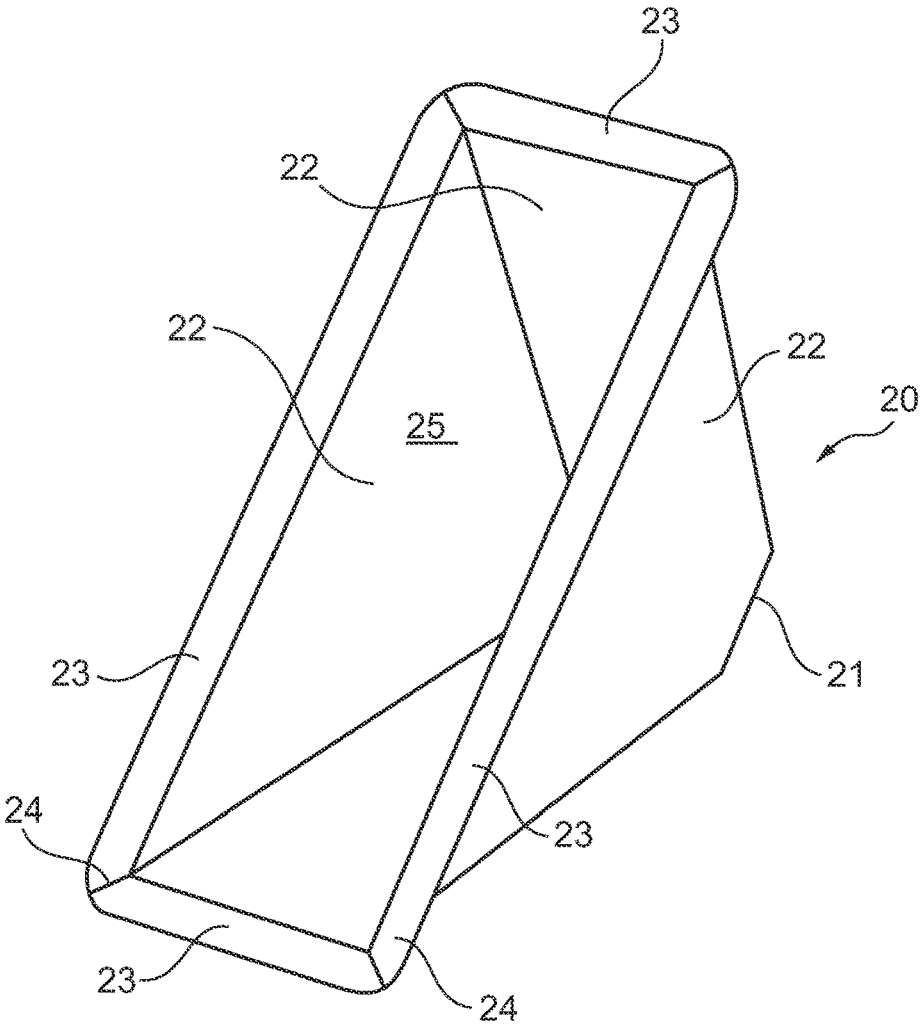
FIG. 5 shows a perspective view of a second embodiment of a packaging according to the invention.

FIG. 5 shows a second embodiment 20 of a packaging according to the invention, which is typically suitable for sandwiches. This packaging 20 has a bottom 21 with wall parts 22 defining an access opening 25 which is bordered by flange parts 23. These flange parts 23 constitute a circumferential flange.

As the flange parts 23, similar to the previous embodiment, abut at the sides 24, a fully flat circumferential flange is provided. When a plastic foil (not shown) is laminated to the inside of the packaging 20, the abutting wall parts 22 and flange parts 23 are kept in position to provide a rigid box 20.

The flat circumferential flange 23 enables a reliable and airtight sealing of a sealing foil after the box 20 is filled with foodstuff.

Figure 6:
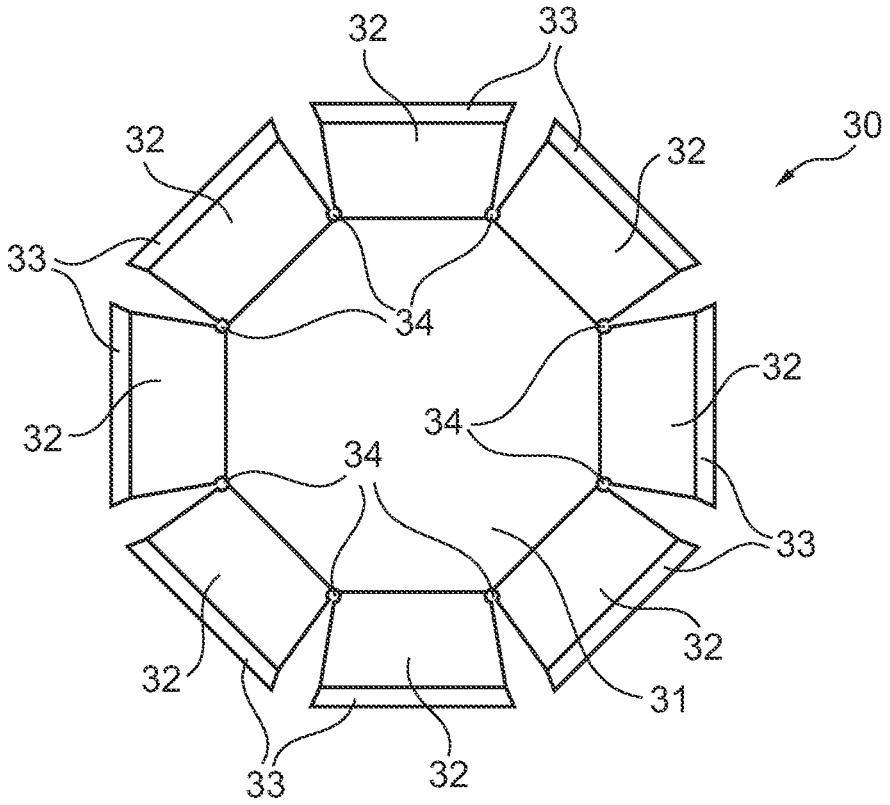
FIG. 6 shows a top view of an unfolded sheet for a third embodiment of a packaging according to the invention.

FIG. 6 shows an unfolded sheet 30 for a third embodiment of a packaging according to the invention. This unfolded sheet 30 has an octagonal bottom part 31 to which wall parts 32 with flange parts 33 are arranged. This unfolded sheet 30 can be used with the method as explained in FIGS. 1A-1D for providing an almost cylindrical packaging.

A cutout portion 34 is arranged at each intersection of two adjacent wall parts 32 and the bottom part 31. This cutout portion 34 will provide a suction opening for creating a low pressure between the box and a heated foil, which is to be laminated to the box.

Figure 7:
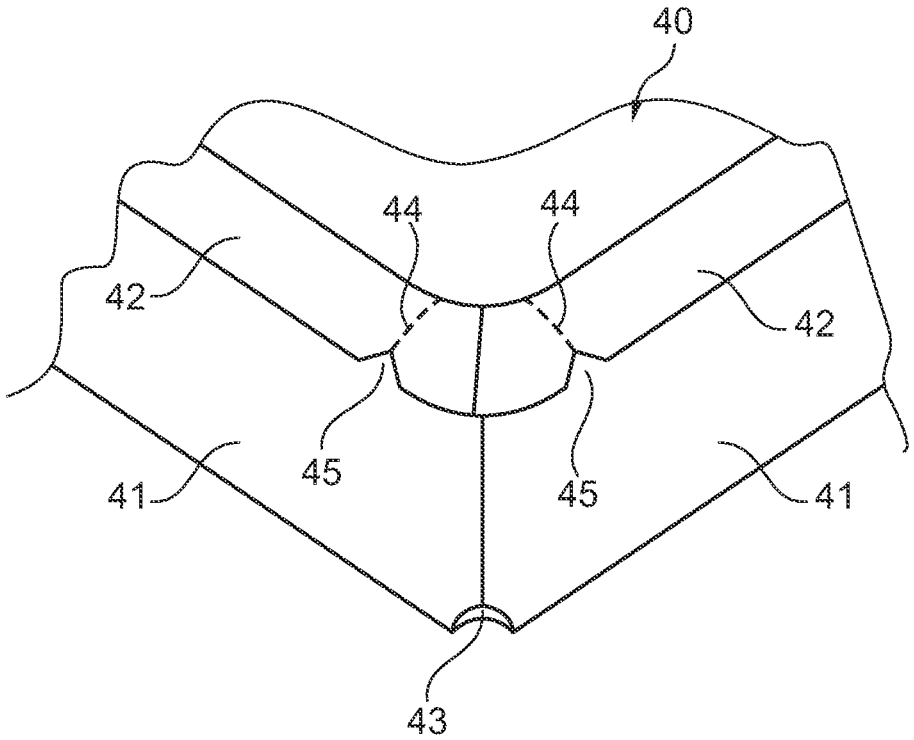
FIG. 7 shows a detail in perspective view of fourth embodiment of a packaging according to the invention.

FIG. 7 shows a detail of a fourth embodiment 40 of a packaging of the invention. The figure shows a corner of two wall parts 41 and two flange parts 42. A suction opening 43 is provided at the bottom corner of the wall parts 41.

The cardboard of the flange parts 42 is provided with two perforation lines 44. At the outer edge of the circumferential flange parts 42, the perforation lines 44 end in a V-shaped cutout 45. These cutouts 45 are also provided in the laminated plastic layer (not shown).

When the packaging 45 is filled with foodstuff and a sealing layer is sealed to the circumferential flange 42, the packaging 45 can be opened by tearing out part of the flange

42 bordered by the two perforation lines 44. Due to the cutouts 45, the laminating layer will be torn when the cardboard of the flange 42 is torn out. This torn out piece will be taken along with the sealing foil, such that the packaging 40 is opened.

Another possibility to open the packaging is to provide a tear tab at the sealing foil or to provide a recess in the flange, such that the sealing foil can be gripped.

The invention claimed is:

1. A method for providing a packaging for modified atmosphere packaging, comprising the steps of:

providing an unfolded sheet for folding a box;

providing a lower mould;

folding the unfolded sheet in and directly against the lower mould into a box having a bottom, wall parts, an access opening and horizontal flange parts bordering the access opening, which flange parts have edges and compose an endless circumferential flange and wherein adjacent flange parts are arranged in a single plane and abut with one another only at their edges and wherein no parts of the sheet are overlapping;

providing a plastic foil;

providing a flat, heated upper mould, wherein the inner surface of the upper mould is provided with a plurality of suction openings;

arranging the plastic foil over the folded box;

pressing the upper mould on top of the lower mould;

heating the plastic foil by sucking the plastic foil against the substantially flat upper mould; and pressing with the upper mould the heated plastic foil against the inner wall of the box and simultaneously against the circumferential flange and generating low pressure between the inner wall of the box and the heated plastic foil through box suction openings arranged at the bottom in the corners of the box, such that the plastic foil is laminated to the box and only the plastic foil is holding the adjacent wall parts and flange parts together.

2. The method according to claim 1, wherein the walls of the box are provided with box suction openings for creating low pressure between the inner wall of the box and the heated plastic foil.

3. The method according to claim 1, wherein the step of folding the unfolded sheet further comprises pressing the unfolded sheet into the lower mould.

4. The method according to claim 1, further comprising the steps of:

filling the box with foodstuff;

providing a sealing foil;

and sealing the sealing foil on the circumferential flange, such that the foodstuff is airtight sealed.

* * * * *